United States Patent [19]

Gonzales et al.

[11] Patent Number: 4,688,544

[45] Date of Patent: Aug. 25, 1987

[54] SELF LOADING WOOD BURNING STOVE

[76] Inventors: Estevan Gonzales; George Spector, both of 233 Broadway Rm 3615, New York, N.Y. 10007

[21] Appl. No.: 874,560

[22] Filed: Jun. 16, 1986

[51] Int. Cl.[4] ..... F24B 13/04; F23K 3/16

[52] U.S. Cl. ..... 126/73; 126/68; 126/10; 110/101 C; 110/116; 110/293

[58] Field of Search ..... 126/7, 10, 68, 73, 74, 126/124; 110/293, 101 R, 101 C, 108, 116, 118

[56] References Cited

U.S. PATENT DOCUMENTS

| | | | |
|---|---|---|---|
| 1,632,176 | 6/1927 | Crain | 126/10 X |
| 3,888,231 | 6/1975 | Galluzzo et al. | 126/10 X |
| 4,201,186 | 5/1980 | Paquin | 126/74 X |
| 4,341,198 | 7/1982 | Sullivan | 126/68 |
| 4,355,587 | 10/1982 | Lemon | 110/293 |
| 4,442,825 | 4/1984 | Waldau | 126/68 |
| 4,444,538 | 4/1984 | Manley | 110/293 |
| 4,606,282 | 8/1986 | Steindal | 110/116 |

FOREIGN PATENT DOCUMENTS

| | | | |
|---|---|---|---|
| 2444892 | 8/1980 | France | 126/10 |

*Primary Examiner*—Margaret A. Focarino

[57] ABSTRACT

A self loading wood burning stove is provided and consists of a storage bin, a fire box and a conveyor for delivering automatically logs individually from the storage bin to the fire box.

2 Claims, 4 Drawing Figures

SELF LOADING WOOD BURNING STOVE

BACKGROUND OF THE INVENTION

The instant invention relates generally to wood burning heating units and more specifically it relates to a self loading wood burning stove.

Numerous wood burning heating units have been provided in prior art that are adapted to automatically feed fuel thereto. For example, U.S. Pat. Nos. 4,355,587; 4,442,825 and 4,444,538 all are illustrative of such prior art. While these units may be suitable for the particular purpose to which they address, they would not be as suitable for the purpose of the present invention as heretofore described.

SUMMARY OF THE INVENTION

A principle object of the present invention is to provide a self loading wood burning stove that will automatically deliver logs from a storage bin to a fire box by the use of a conveyor.

Another object is to provide a self loading wood burning stove that will automatically place the logs from the conveyor into the upper portion of the fire box.

An additional object is to provide a self loading wood burning stove that has a timer that will periodically activate the conveyor at predetermined intervals.

A further object is to provide a self loading wood burning stove that is economical in cost to manufacture.

A still further object is to provide a self loading wood burning stove that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
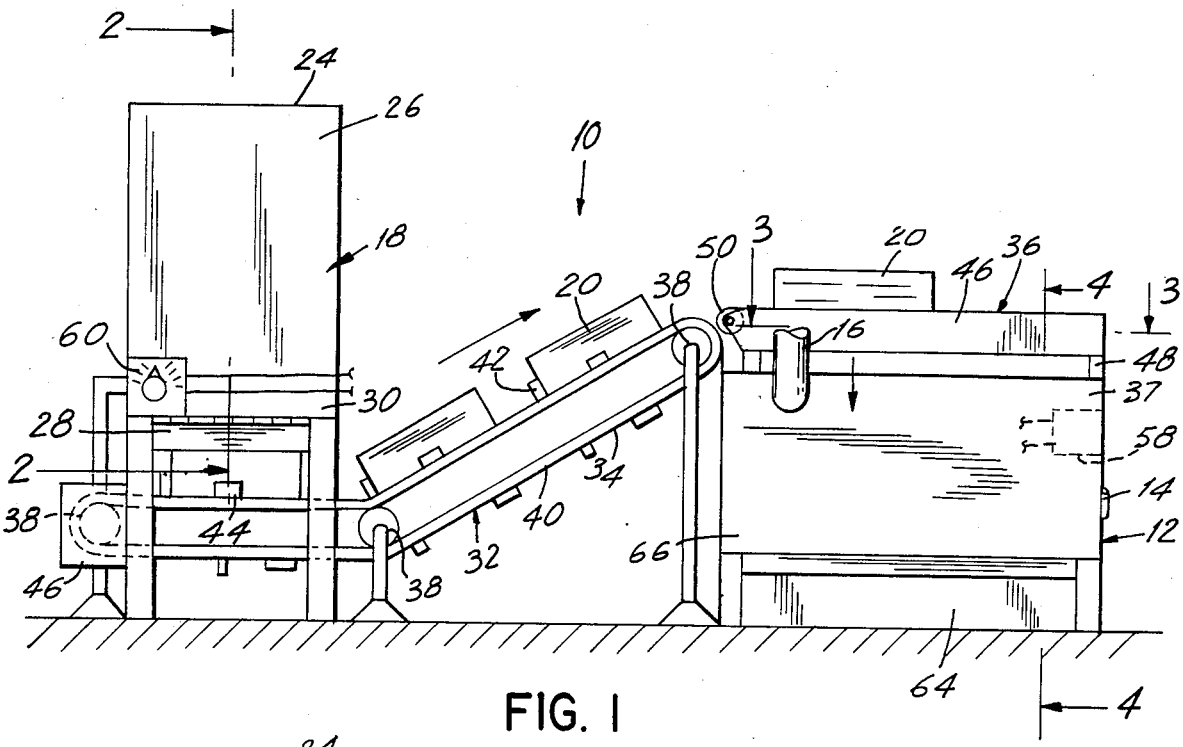
FIG. 1 is a side view of the invention.

Turning now descriptively to the drawings, in which similar reference characters denote similar elements throughout the several views, FIGS. 1 through 4 illustrates a self loading wood burning stove 10, that contains a fire box 12 that has an air intake vent 14 for supplying a flow of combustable air therein and an exhaust conduit 16 in flow communication with the fire box 12 for exhausting combustion gases therefrom. The intake vent 14 can be a perforated door so that starting materials such as paper or the like can be inserted under a grate 16 within the fire box 12.

Figure 2:
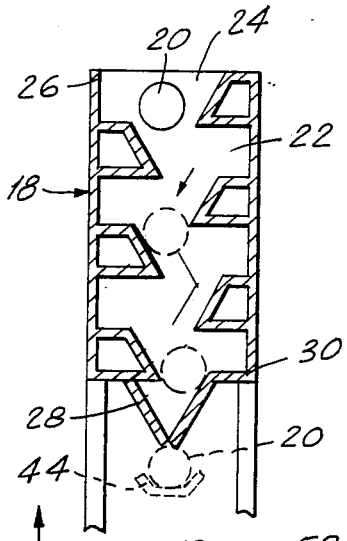
FIG. 2 is a cross sectional view taken along line 2—2 in FIG. 1 through the storage bin.
Figure 3:
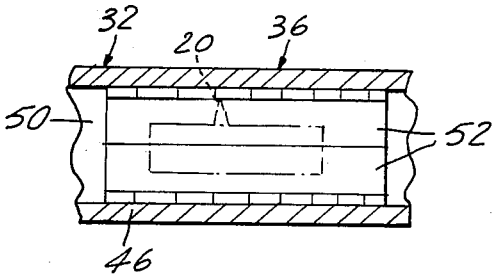
FIG. 3 is a cross sectional view taken along line 3—3 in FIG. 1 through the housing having trap doors.
Figure 4:
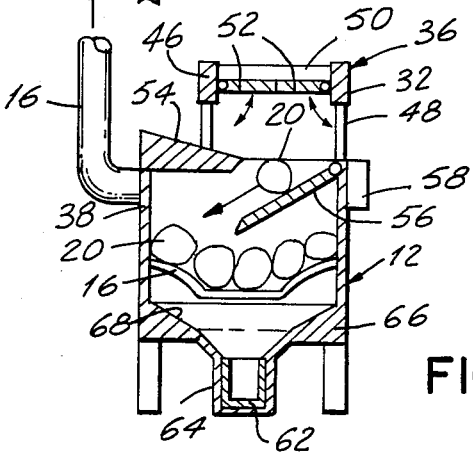
FIG. 4 is a cross sectional view taken along line 4—4 in FIG. 1 through the fire box.

As best seen in FIG. 2 a storage bin 18 is for retaining a plurality of logs 20. The storage bin 18 has a generally zig-zag vertically arranged compartment 22 for holding a zig-zag row of logs 20. The storage bin 18 has a log entry opening 24 at upper portion 26 and a pair of pivotable doors 28 at lower portion 30 for dispensing the logs 20 individualy therefrom.

A device 32 is provided for delivering the logs 20 from the doors 28 of the storage bin 18 to the fire box 12 of the stove 10. The delivering device 32 consists of a conveyor and a structure 36. The conveyor 34 receives the logs 20 one at a time from the doors 28 of the storage bin 18 and conducts the logs 20 upwardly in a substantially angular fashion. The length and angle of the conveyor 34 can vary for specific conditions of the stove 10. The structure 36 is for placing the logs 20 from the conveyor 34 into upper portion 37 of the fire box 12.

The conveyor 34 contains a plurality of rollers 38. An endless belt 40 is formed around the rollers 38 and has a plurality of push lugs 42. The belt 40 has V-shaped members 44 thereon to prevent the logs 20 from rolling off. A motor 46 drives one of the rollers 38 to operate the belt 40 so that each push lug 42 will drive each log 20 upwardly.

The structure 36 contains a housing 46 with legs 48 mounted to the upper portion 38 of the fire box 12. The housing 46 has a log guide roller 50 in rotatable contact with the belt 40 of the conveyor 34 and a pair of spring loaded trap doors 52 that are opened by weight of the log 20 so that the log will fall therethrough.

The fire box 12 has an inclined top 54 and a pivotable top door 56 that is opened by weight of the log 20 so that the log 20 will roll therein. A switch 58 is activated by opening of the top door 56 of the fire box 12. A timer 60 is electrically connected between the switch 58 and the motor 46 of the conveyor 34. When the switch 58 is activated the timer 60 will shut off the motor 46 thus allowing the motor to be periodically activated by the timer at predetermined intervals.

An ash pan 62 is slideably positioned within a tray 64 at the lower portion 66 of the fire box 12 to trap the ashes. The floor 68 is sloped inwardly to the ash pan 62 so that the ash pan can catch all the ashes therein. The ash pan 62 slides in and out of the tray 64 for easy cleaning.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A self loading wood burning stove which comprises:

(a) a fire box having an air intake vent for supplying a flow of combustable air therein and an exhaust conduit in flow communication with said fire box for exhausting combustion gases therefrom:

(b) a storage bin for retaining a plurality of logs, said storage bin having a generally zig-zag vertically arranged compartment for holding a zig-zag row of said logs, said storage bin having a log entry opening at upper portion and a pair of pivotable doors at lower portion for dispensing said logs individually therefrom; and (c) means for delivering said logs from said doors of said storage bin to said fire box of said stove, wherein said delivering means comprises:

(d) a conveyor for receiving said logs from said doors of said storage bin and conducting said logs upwardly in a substantially angular fashion; and (e) means for placing said logs from said conveyor into upper portion of said fire box; wherein said conveyor comprises:

(f) a plurality of rollers;

(g) an endless belt formed around said rollers, said belt having a plurality of push lugs; and (h) a motor to drive one of said rollers to operate said belt so that each said push lug will drive each said log upwardly; wherein said placing means comprises:

(i) a housing having a plurality of legs mounted to said upper portion of said fire box, said housing having a log guide roller in rotatable contact with said belt of said conveyor and a pair of spring loaded trap doors that are opened by weight of said log so that said log will fall therethrough; and (j) said first box having an inclined top and a pivotable top door that is opened by weight of said log so that said log will roll therein.

2. A self loading wood burning stove as recited in claim 1, further comprising:

(k) a switch activated by opening of said top door of said fire box; and (l) a timer electrically connected between said switch and said motor of said conveyor whereby when said switch is activated said timer will shut off said motor thus allowing said motor to be periodically activated by said timer at predetermined intervals.

* * * * *